US008952981B2

(12) United States Patent
Saini et al.

(10) Patent No.: US 8,952,981 B2
(45) Date of Patent: Feb. 10, 2015

(54) SUBPIXEL COMPOSITING ON TRANSPARENT BACKGROUNDS

(75) Inventors: Shailesh Saini, Kirkland, WA (US); Alexandre Gueniot, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 152 days.

(21) Appl. No.: 13/305,298

(22) Filed: Nov. 28, 2011

(65) Prior Publication Data

US 2013/0135339 A1 May 30, 2013

(51) Int. Cl.
*G09G 5/00* (2006.01)

(52) U.S. Cl.
USPC ..... 345/613

(58) Field of Classification Search
CPC ..... G09G 2340/0457; G06T 2200/12
See application file for complete search history.

(56) References Cited

U.S. PATENT DOCUMENTS

| | | | | |
|---|---|---|---|---|
| 4,908,780 | A * | 3/1990 | Priem et al. | 345/611 |
| 5,940,080 | A * | 8/1999 | Ruehle et al. | 345/611 |
| 6,894,702 | B2 | 5/2005 | Stamm et al. | |
| 7,222,306 | B2 * | 5/2007 | Kaasila et al. | 715/801 |
| 7,230,624 | B2 | 6/2007 | Lengyel | |
| 7,280,120 | B2 | 10/2007 | Ecob et al. | |
| 7,580,039 | B2 | 8/2009 | Dowling et al. | |
| 8,314,812 | B1 * | 11/2012 | Eckel | 345/629 |
| 2005/0110804 | A1 | 5/2005 | Hancock et al. | |
| 2005/0253865 | A1 | 11/2005 | Proteau | |
| 2010/0079480 | A1 * | 4/2010 | Murtagh | 345/592 |

OTHER PUBLICATIONS

Duff et al., "Compositing Digital Images," Jul. 1984, Computer Graphics, v. 18, No. 3, pp. 253-259.*

Sneath,Tim; "A-Guided-Tour-of-Windows-Presentation-Foundation"—Microsoft Corporation, Sep. 2005, 36 pages.

* cited by examiner

*Primary Examiner* — Kee M Tung
*Assistant Examiner* — Nicholas R Wilson
(74) *Attorney, Agent, or Firm* — Steve Crocker; Jim Ross; Micky Minhas

(57) ABSTRACT

A method is presented for displaying a rendered image on an electronic computing device. The method comprises rendering a first image on the electronic computing device. The first image is rendered on a white background. A second image is rendered on the electronic computing device. The second image is rendered on a black background. The first image, the second image and a background image are combined to produce a third image. The third image is a composite of the first image, the second image and the background image. The third image is displayed on a display screen of the electronic computing device. The third image includes anti-aliasing for a plurality of subpixels of the third image.

17 Claims, 5 Drawing Sheets

SUBPIXEL COMPOSITING ON TRANSPARENT BACKGROUNDS

BACKGROUND

When text and graphics are displayed on a computer screen, anti-aliasing is commonly used to improve clarity of the displayed image. The anti-aliasing helps to reduce jagged edges in the displayed text and graphics. The jagged edges are a distortion in the displayed image that typically occurs when a high resolution image is displayed at a lower resolution.

One form of anti-aliasing reduces image distortion by highlighting selective subpixels of the displayed image and adjusting a color value and opacity for the selected subpixels. By varying a color value of the subpixels and by adjusting opacity of the subpixels, the clarity of the displayed image can be improved. However, when using this form of anti-aliasing to display moving images on transparent backgrounds on a computer screen, performance issues may occur when providing anti-aliasing for the moving image.

SUMMARY

Embodiments of the disclosure are directed to a method for displaying a rendered image on an electronic computing device. The method comprises rendering a first image on the electronic computing device. The first image is rendered on a white background. A second image is rendered on the electronic computing device. The second image is rendered on a black background. The first image, the second image and a background image are combined to produce a third image. The third image is a composite of the first image, the second image and the background image. The third image is displayed on a display screen of the electronic computing device. The third image includes anti-aliasing for a plurality of subpixels of the third image.

This Summary is provided to introduce a selection of concepts, in a simplified form, that are further described below in the Detailed Description. This Summary is not intended to identify key or essential features of the claimed subject matter, nor is it intended to be used in any way to limit the scope of the claimed subject matter.

DETAILED DESCRIPTION

Figure 1:
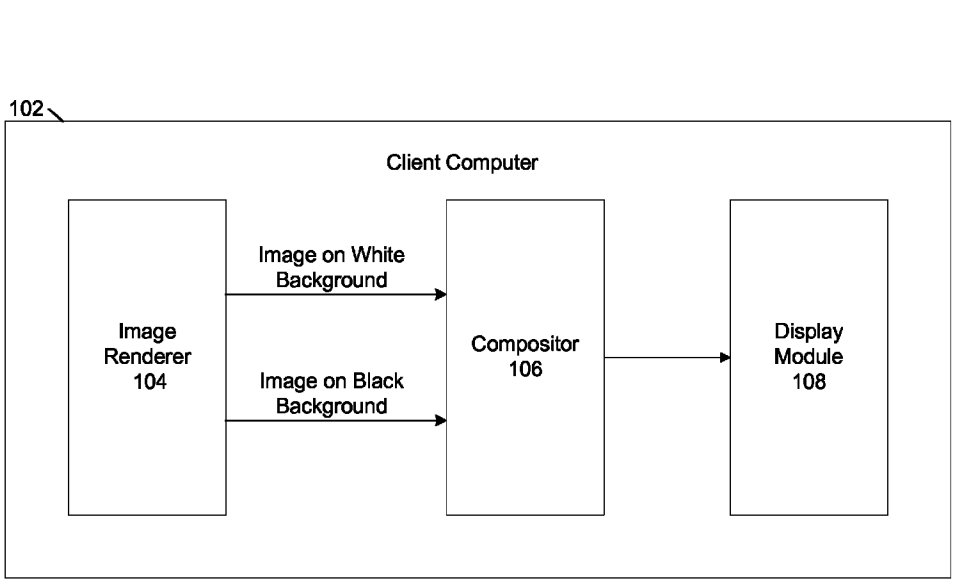
FIG. 1 shows an example system that supports subpixel compositing on a transparent display screen image.

The present application is directed to systems and methods for subpixel compositing on transparent display screen backgrounds. The systems and methods provide for rendering two images of an object and providing the two images to a compositor. The compositor produces a composite image that may be displayed on a display screen of a computing device. The compositor uses information stored in the two rendered images to calculate an opacity for each subpixel in the composite image. The calculation of the opacity for each subpixel permits a method of anti-aliasing to be used with the compositor. The anti-aliasing helps to improve the clarity of the image on the display screen.

In examples, a display screen is comprised of a plurality of pixels. Each pixel is further comprised of three subpixels. Each subpixel represents a different primary color—red, green and blue. When text or graphics are displayed on the display screen, the displayed text or graphics may include jagged edges that may make the displayed text or graphics appear distorted. The jagged images are typically caused by the nature of the pixel display. For example, pixels typically appear as small square areas on the display screen. When a curved or slanted character, such as the number 3 or a slanted line is displayed, the square display of the pixels typically do not provide the needed resolution to display the number 3 or the slanted line without including jagged edges.

One example method of anti-aliasing that may be used to improve the resolution of displayed images is the ClearType® subpixel rendering technology from Microsoft Corporation of Redmond, Wash. Using the ClearType® subpixel rendering technology, an opacity is determined for each subpixel of a displayed image. By determining values for both opacity and intensity, subpixels adjacent to jagged edges in a display image may be adjusted to a degree of highlighting such that the jagged edges appear softened and less apparent to a viewer.

When displaying moving or static objects on a display screen a compositor is often used to improve display performance. Examples of a moving object on a display screen include a transition or animation in a slide show application. Other examples include a moving object in other animation applications. For static images, caching and redrawing the static image may improve display performance. The systems and methods in this disclosure may be used to improve display performance of both moving and static objects.

The compositor combines separate visual images into a single image. For example, an animation is typically formed from separate image layers that are combined into a single image. For text objects that are displayed during a slide show animation, for example a fly-in of a text object, the compositor may be used to combine the text object with a background image on the display screen. In examples, text objects may be shown with different transparencies and background colors. When a text object moves on the display screen during the animation, opacity values may need to be adjusted for each subpixel to maintain a uniform transparency of the text object as the text object moves on the display screen.

For performance reasons, when displaying a moving object on a display screen, it is usually more efficient to render an image on the display screen and then move the rendered image on the display screen. This is typically more efficient than rendering the image at each position as the image is moved on the display screen. When an image is stored, a data value representing color and opacity is typically stored for each pixel in the image. The data value, often known as an RGBA value, indicates a color value for R (red), G (green) and B (blue) subpixels of the pixel and an opacity value A for the pixel. In examples each color value for red, green and blue is a number from 0 to 1, where 1 represents full color and 0 represents no color. The opacity value is typically a number from 0 to 1 that translates to a percent of opacity. For example, a value of 1 represents maximum opacity, corresponding to zero transparency. A value of zero represents minimum opacity, corresponding to the pixel being 100% transparent. A value of 0.5 represents 50% transparency.

In order to provide anti-aliasing for the moving object similar to anti-aliasing provided for a static object using the ClearType® subpixel rendering technology, an opacity is provided for each subpixel of the moving object. However, as discussed earlier, when an image is stored, opacity is only stored for each pixel of the image (via RGBA) but opacity is not stored for each subpixel of the image.

Using the systems and methods described herein, two images are stored for an object and an opacity is calculated for each subpixel of the image using RGB values for the two images stored. One image that is stored is based on rendering an image of the object against a white background and another image that is stored is based on rendering the image of the object against a black background. The two images are then provided to the compositor. As described in detail herein, an opacity for each subpixel of the image is calculated by subtracting a rendered output for the subpixel on the black background from a rendered output for the subpixel on a white background.

FIG. 1 shows an example system 100 that supports subpixel compositing on a transparent display screen image. The example system 100 includes a client computer 102. The example client computer 102 includes an image renderer 104, a compositor 106 and an example display module 108. The example image renderer 104 renders two images of an object. One of the two images is an image of the object on a white background. The other of the two images is an image of the object on a black background. The object is an element to be displayed on a display screen of the client computer. When each image is rendered, RGBA information is stored for each pixel of the rendered image. As described in more detail later herein, the RGBA information for the two images is used to calculate the opacity for each subpixel in the rendered image.

The example compositor 106 receives the two images and uses the RGBA information for the two images in conjunction with a background image on the display screen to calculate the opacity for each subpixel in the rendered image. When the opacity for each subpixel in the rendered image is calculated, the image may be moved on the computer screen without needing to re-render the image multiple times as the image is moved. Moving the image without re-rendering the image improves application performance. For example, generating a fly-in animation for a word or phrase on a Powerpoint® slideshow presentation is done more efficiently and less expensively by moving a rendered image than re-rendering the image multiple times as the image moves across the display screen.

The example display module 108 displays rendered images on the display screen of client computer 102.

Figure 2:
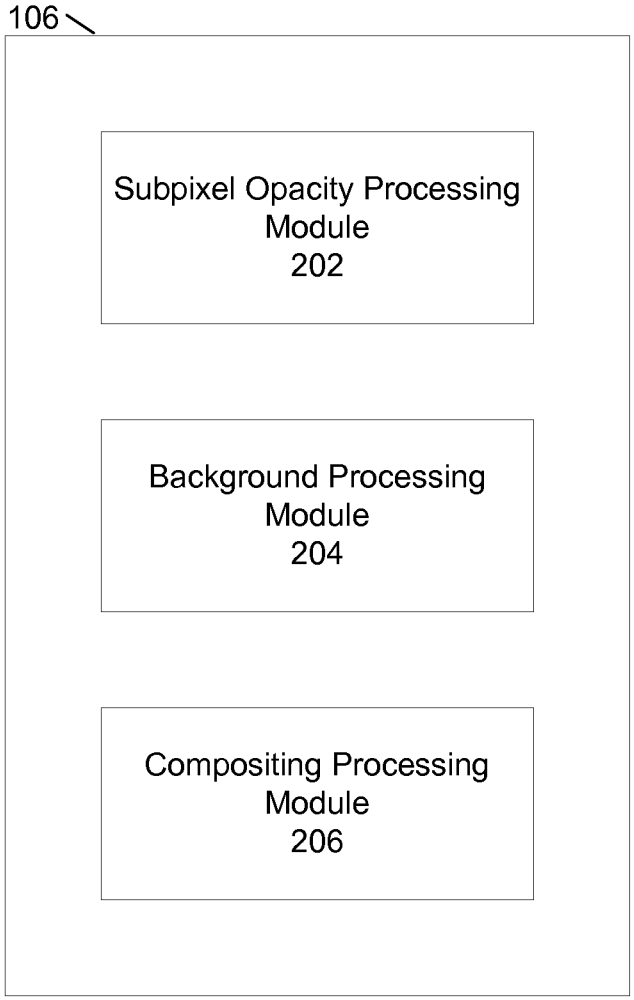
FIG. 2 shows example components of the compositor of FIG. 1.

FIG. 2 shows example modules of the compositor 106. The example modules of the compositor 106 include a subpixel opacity processing module 202, a background processing module 204 and a compositing processing module 206. The example subpixel opacity processing module 202 receives the two rendered images and calculates an opacity for each subpixel in the rendered images. As discussed, one of the rendered images is a rendered image for an object against a white background and the other rendered image is a rendered image for an object against a black background.

When an image is rendered on a display screen, a background pattern on the display screen and a transparency of the image need to be taken into account. An image may be displayed with varying degrees of transparency. When an image is completely opaque (having zero transparency), the background beneath the object cannot be seen. Similarly, when the image is completely transparent (having zero opacity), the background can be seen but the object is invisible. When an image has an opacity between zero and one, part of the image can be seen and part of the background can be seen. When a black image having an opacity of 1 (zero transparency) is viewed against a black background, the image is blended into the background and cannot be seen. However, when a black image having the same opacity is viewed on a white background or when a black image having an opacity of zero (fully transparent) is viewed on a black background, the image is fully visible.

The display of an object (for example a word of text) on a background blends a color of the object with a color of the background. In computer graphics, the output of an object against a background is given be the following equation:

$$\text{output}=\text{background}*(1-\alpha)+\text{color}*\alpha \quad (1)$$

where, output is an intensity of a pixel or subpixel background is an intensity of a background image beneath the pixel or subpixel color is a number from 0 to 1, representing an intensity of a subpixel, and $\alpha$ is an opacity of a pixel or subpixel When text is rendered on a white background, equation 1 may be re-written as $$W=1*(1-\alpha)+\text{color}*\alpha \quad (2)$$

For the case of text rendered on a white background, because the background is white, the background term in the equation has a value of 1. The output W represents an output color value for the object rendered on a white background.

When text is rendered on a black background, equation 1 may be re-written as $$B=0*(1-\alpha)+\text{color}*\alpha=\text{color}*\alpha \quad (3)$$

For the case of text rendered on a black background, because the background is black, the background term in the equation has a value of 0. The output B represents an output color value for the object rendered on a black background.

When equation (3) is subtracted from equation (2), the result is $$W-B=1-\alpha$$

Thus the opacity $\alpha$ for a subpixel may be calculated from the W−B term.

Substituting (W−B) for $(1-\alpha)$ in equation (1) and substituting B for color*$\alpha$ (per equation 3), output equation 1 may be re-written as:

$$\text{output}=\text{background}*(W-B)+B \quad (1a)$$

Thus, using rendered images for an object against a white and black background, the subpixel opacity processing module 202 calculates an opacity for each subpixel in a rendered image by performing a W−B subtraction for each subpixel in the rendered image. The opacity of each subpixel is not needed in the calculation for the output (equation 1a) and therefore does not need to be stored.

The example background processing module 204 calculates a color value for a background image for each subpixel on the display screen. The color value is a number between zero and one. For example, each subpixel can have a value between 0 and 1, zero representing no color and 1 representing full color, i.e. maximum values of red, blue or green.

If the subpixel has full color, the value is 1. If the subpixel has no color, the value is zero. For subpixels that have intermediate values of red, blue or green, the background color value is determined by dividing the color value by 1. For example if a subpixel has a color value of 0.5, the background value is 0.5/1 or 0.5. The background color value is used in equation 1a to determine an output value for a subpixel of a rendered image on the display screen. A background color value is calculated for each subpixel of the rendered image on the display screen.

The example compositing processing module 206 receives the two rendered images of the object and the background image on the display screen and generates a composite image of the object against the background. The composite image is generated for each subpixel of the object using equation 1a. Thus, at each position at which the object is displayed on the display screen, for each subpixel in the rendered image of the object and for one or more additional subpixels adjacent to the rendered image, the background value for the subpixel, as calculated in the background processing module 204, is multiplied by (W−B) and added to B.

The result is a color value of the subpixel that takes into account the background image and that takes into account a transparency for the subpixel. The transparency is taken into account via the opacity ($\alpha$), which although not explicitly included in equation 1a, is implicitly included because of the (W−B) term. As discussed, the W and B terms result from rendering the object against white and black backgrounds using the ClearType® subpixel rendering technology. This technology uses subpixel opacities. The one or more additional subpixels adjacent to the rendered image correspond to subpixels used as part of the ClearType® subpixel rendering technology to improve clarity for the rendered image.

Figure 3:
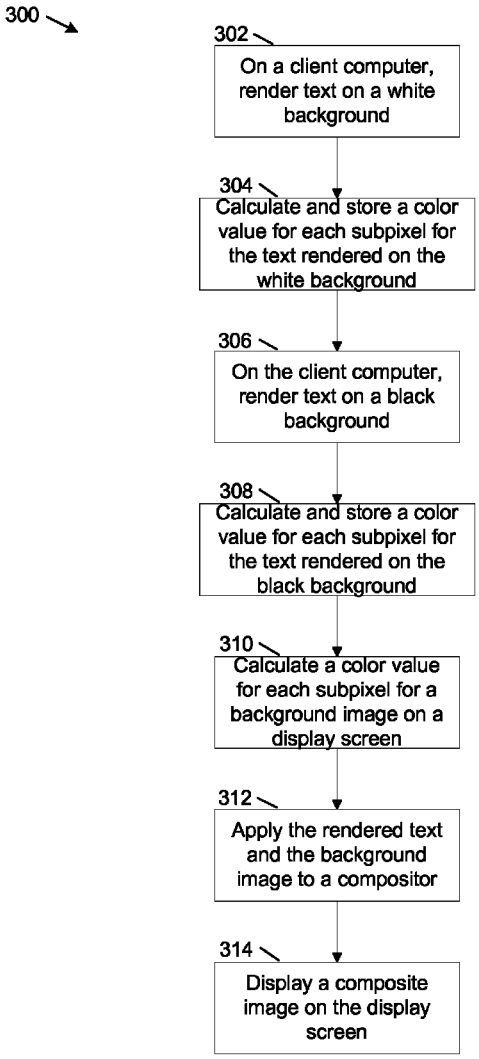
FIG. 3 shows an example flowchart of a method for displaying a rendered text image on a display screen of a client computer.

FIG. 3 shows an example flowchart of a method 300 for displaying a rendered text image on a display screen of a client computer. At operation 302, the text is rendered on a white background on the client computer. At operation 304, a color value is calculated and stored for each subpixel for the text rendered on the white background. The color value represents a color intensity for a subpixel. In examples, the color value may be a decimal number between zero and one, with one representing a maximum color value.

At operation 306, the text is rendered on a black background on the client computer. At operation 308, a color value is calculated and stored for each subpixel in the text rendered on the black background. The color value represents a color intensity for the subpixel. In examples, the color value may be a decimal number between zero and one, with one representing a maximum color value.

At operation 310, a color value is calculated for each subpixel of a background image on the display screen. In examples the background image may be a solid color or a pattern. The background image may be a static image or the background image may be a dynamic image which changes over time.

At operation 312, the rendered images and the background image are applied to a compositor. The compositor uses the stored color values for the rendered images and the background image to calculate color values for a composite image. The composite image includes antialiasing information. At operation 314, the composite image is displayed on the display screen.

Figure 4:
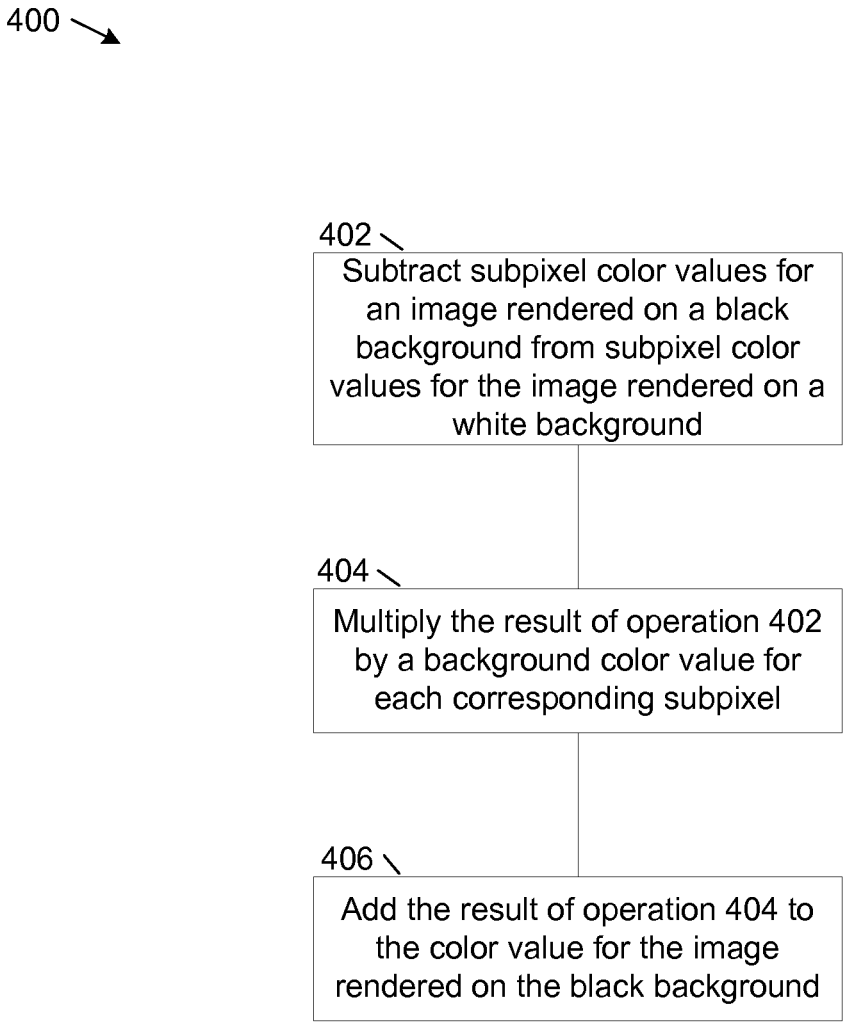
FIG. 4 shows an example flowchart of a method for calculating subpixel color values for a composite image rendered on a display screen.

FIG. 4 shows an example flowchart of a method 400 for calculating subpixel color values for a composite image rendered on a display screen. The method 400 corresponds to the process for operations 308 and 310. In examples, the composite image represents text rendered on the display screen. In other examples, objects besides text are rendered on the display screen. The method results in a composite image that includes antialiasing for each subpixel in the rendered image.

At operation 402, subpixel color values for an image rendered on a black background are subtracted from subpixel color values for the image rendered on a white background. A color value for each subpixel color value for the image rendered on the black background is subtracted from a color value for a corresponding subpixel for the image rendered on the white background.

At operation 404, for each subtraction in operation 402, the result of the subtraction for a subpixel is multiplied by a color value in a background image on the display screen at a corresponding subpixel location. For example, for each subpixel in the composite image, the result of the subtraction operation for the subpixel at operation 402 is multiplied by the color value of the background image at the same subpixel location in the composite image.

At operation 406, for each subpixel location in the composite image, the result of operation 404 is added to the color value for the image rendered on the black background. The result of performing operation 406 for each subpixel in the composite image is an image that includes anti-aliasing for each subpixel in the composite image.

Figure 5:
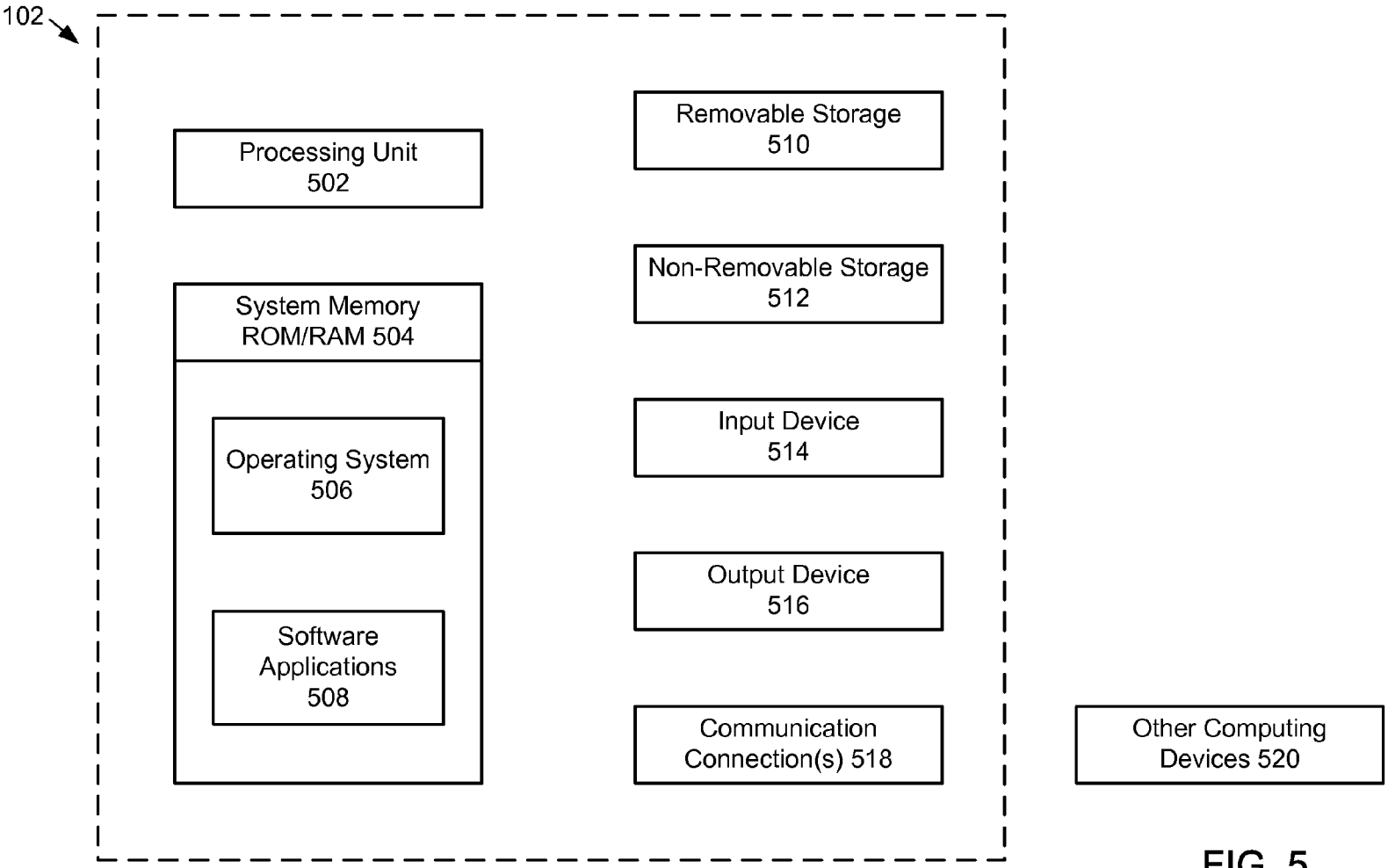
FIG. 5 shows example components of the client computer of FIG. 1.

With reference to FIG. 5, example components of client computer 102 are shown. In example embodiments, client computer 102 is a computing device. Client computer 102 can include input/output devices, a central processing unit ("CPU"), a data storage device, and a network device. Client computer 102 can also be a mobile computing device, such as a laptop, tablet, convertible, or other handheld device like a smartphone or cellular telephone.

In a basic configuration, client computer 102 typically includes at least one processing unit 502 and system memory 504. Depending on the exact configuration and type of computing device, the system memory 504 may be volatile (such as RAM), non-volatile (such as ROM, flash memory, etc.) or some combination of the two. System memory 504 typically includes an operating system 506 suitable for controlling the operation of a client computer. The system memory 504 may also include one or more software applications 808 and may include program data.

The client computer 102 may have additional features or functionality. For example, client computer 102 may also include computer readable media. Computer readable media can include both computer readable storage media and communication media.

Computer readable storage media is physical media, such as data storage devices (removable and/or non-removable) including magnetic disks, optical disks, or tape. Such additional storage is illustrated in FIG. 5 by removable storage 510 and non-removable storage 512. Computer readable storage media may include volatile and nonvolatile, removable and non-removable media implemented in any method or technology for storage of information, such as computer readable instructions, data structures, program modules, or other data. Computer readable storage media can include, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by client computer 102. Any such computer readable storage media may be part of client computer 102. Client computer 102 may also have input device(s) 514 such as keyboard, mouse, pen, voice input device, touch input device, etc. Output device(s) 516 such as a display, speakers, printer, etc. may also be included.

Consistent with embodiments of the present disclosure, the input device(s) 514 may comprise any motion detection device capable of detecting the movement or gesture of a user. For example, the input device(s) 514 may comprise a Kinect® motion capture device, from Microsoft Corporation, comprising a plurality of cameras and a plurality of microphones.

The client computer 102 may also contain communication connections 518 that allow the device to communicate with other computing devices 520, such as over a network in a distributed computing environment, for example, an intranet or the Internet. Communication connections 518 are one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media.

Embodiments of the present disclosure may be practiced via a system-on-a-chip (SOC) where each or many of the components illustrated in FIG. 5 may be integrated onto a single integrated circuit. Such an SOC device may include one or more processing units, graphics units, communication units, system virtualization units and various application functionality all of which are integrated (or "burned") onto the chip substrate as a single integrated circuit. When operating via an SOC, the functionality, described above, with respect to the present disclosure may be operated via application-specific logic integrated with other components of the computing device 102 on the single integrated circuit (chip).

The various embodiments described above are provided by way of illustration only and should not be construed to limiting. Various modifications and changes that may be made to the embodiments described above without departing from the true spirit and scope of the disclosure.

What is claimed is:

1. A method for displaying a rendered image on an electronic computing device, the method comprising:

rendering a first image of an object on the electronic computing device, the first image being rendered on a white background;

rendering a second image of the object on the electronic computing device, the second image being rendered on a black background;

storing a data value for each of a plurality of pixels in the rendered first image and the rendered second image, the data value comprising a plurality of subpixel color values and a pixel opacity value;

combining the first image, the second image and a background image to produce a third image, the third image being a composite of the first image, the second image and the background image; and displaying the third image on a display screen of the electronic computing device, wherein the third image includes anti-aliasing for a plurality of subpixels of the third image, the anti-aliasing comprising a determination of opacity and intensity values for each of the plurality of subpixels, the opacity values for each of the plurality of subpixels being determined utilizing the stored data value.

2. The method of claim 1, wherein the third image is moved to a plurality of positions on the display screen, the third image including anti-aliasing for the plurality of subpixels of the third image at each of the plurality of positions on the display screen.

3. The method of claim 1, wherein combining the first image, the second image and a background image to produce a third image comprises subtracting a subpixel color value for the second image from a subpixel color value for the first image for a plurality of subpixels of the first image and the second image.

4. The method of claim 3, wherein the result of each subtraction is equal to one minus an opacity.

5. The method of claim 3, further comprising multiplying the result of the subtraction by a color value for the background image corresponding to the subpixel.

6. The method of claim 5, further comprising calculating an output value for the subpixel, the output value being a subpixel color value for displaying the subpixel on the display screen, the output value for the subpixel being equal to the sum of 1) the multiplication of the result of the subtraction by the color value for the background image corresponding to the subpixel and 2) a subpixel color value for the second image corresponding to the subpixel.

7. The method of claim 6, wherein the output value for the subpixel is represented by the equation:

$$\text{output}=\text{background}*(W-B)+B$$

where, background is a color value of a subpixel in the background image,

W is a color value for the subpixel in the first image,

B is a color value for the subpixel in the second image.

8. The method of claim 1, wherein the background image comprises a background pattern on the display screen.

9. The method of claim 8, wherein the background pattern is static.

10. The method of claim 8, wherein the background pattern is dynamic.

11. An electronic computing device comprising:

a processing unit; and system memory, the system memory including instructions that, when executed by the processing unit, cause the electronic computing device to:

render a first image of an object on the electronic computing device, the first image being rendered on a white background;

render a second image of the object on the electronic computing device, the second image being rendered on a black background;

store a data value for each of a plurality of pixels in the rendered first image and the rendered second image, the data value comprising a plurality of subpixel color values and a pixel opacity value;

combine the first image, the second image and a background image to produce a third image, the third image being a composite of the first image, the second image and the background image; and display the third image on a display screen of the electronic computing device, wherein the third image includes anti-aliasing for a plurality of subpixels of the third image, the anti-aliasing comprising a determination of opacity and intensity values for each of the plurality of subpixels, the opacity values for each of the plurality of subpixels being determined utilizing the stored data value.

12. The electronic computing device of claim 11, wherein the third image is moved to a plurality of positions on the display screen, the third image including anti-aliasing for the plurality of subpixels of the third image at each of the plurality of positions on the display screen.

13. The electronic computing device of claim 11, wherein combining the first image, the second image and a background image to produce a third image causing the electronic computing device to:

subtract a subpixel color value for the second image from a subpixel color value for the first image;

multiply the result of the subtraction by a color value for the background image corresponding to the subpixel; and calculate an output value for the subpixel, the output value being a subpixel color value for displaying the subpixel on the display screen, the output value for the subpixel being equal to the sum of 1) the multiplication of the result of the subtraction by the color value for the background image and 2) a subpixel color value for the second image corresponding to the subpixel.

14. The electronic computing device of claim 13, wherein the output value for the subpixel is represented by the equation:

$$\text{output}=\text{background}*(W-B)+B$$

where, background is a color level of the subpixel corresponding to the background display, W is a color value for the subpixel for the first image, B is a color value for the subpixel for the second image.

15. The electronic computing device of claim 13, wherein the result of subtracting the subpixel color value for the second image from the subpixel color value for the first image is equal to one minus an opacity for the subpixel.

16. The electronic computing device of claim 13, wherein the background image comprises a background pattern on the display screen.

17. A computer readable storage device comprising instructions that, when executed by an electronic computing device, cause the electronic computing device to:

render a first image of an object on the electronic computing device, the first image being rendered on a white background;

render a second image of the object on the electronic computing device, the second image being rendered on a black background;

store a data value for each of a plurality of pixels in the rendered first image and the rendered second image, the data value comprising a plurality of subpixel color values and a pixel opacity value;

combine the first image, the second image and a background image to produce a third image, the third image being a composite of the first image, the second image and the background image, the background image comprising a pattern on the display screen, the combining of the first image, the second image and a background image to produce a third image causing the electronic computing device to:

subtract a subpixel color value for the second image from a subpixel color value for the first image for a plurality of subpixels of the first image and the second image, the result of each subtraction being equal to one minus an opacity for the subpixel;

multiply the result of the subtraction by a color value for the background image corresponding to the subpixel; and calculate an output value for the subpixel, the output value being a subpixel intensity level for displaying the subpixel on the display screen, the output value for the subpixel being equal to the sum of 1) the multiplication of the result of the subtraction by the color value for the background image and 2) a subpixel color value for the second image corresponding to the subpixel; and display the third image at a plurality of positions on a display screen of the electronic computing device, wherein the third image includes anti-aliasing for a plurality of subpixels of the third image at each of the plurality of positions on the display screen, the anti-aliasing comprising a determination of opacity and intensity values for each of the plurality of subpixel, the opacity values for each of the plurality of subpixels being determined utilizing the stored data value.

* * * * *